US006198080B1

(12) United States Patent
Rice et al.

(10) Patent No.: US 6,198,080 B1
(45) Date of Patent: Mar. 6, 2001

(54) GLASS TOUCH COOKTOP DUAL ELEMENT AND BRIDGE BURNER CONTROL

(75) Inventors: Steven Andrew Rice, Shelbyville, KY (US); Marc Eric Hottenroth, New Albany, IN (US)

(73) Assignee: General Electric Company, Louisville, KY (US)

( * ) Notice: Subject to any disclaimer, the term of this patent is extended or adjusted under 35 U.S.C. 154(b) by 0 days.

(21) Appl. No.: 09/368,148

(22) Filed: Aug. 5, 1999

(51) Int. Cl.[7] ..... H05B 1/02

(52) U.S. Cl. ..... 219/506; 219/483; 219/486; 219/412; 219/414; 219/453; 219/445; 219/508

(58) Field of Search ..... 219/483–486, 219/501, 494, 440–444, 508, 506, 509, 448, 505, 445, 453; 307/117, 118

(56) References Cited

U.S. PATENT DOCUMENTS 3,974,472 * 8/1976 Gould, Jr. ..... 219/506
4,511,781 * 4/1985 Tucker et al. ..... 219/506
5,717,189 * 2/1998 Goetz et al. ..... 219/483

* cited by examiner

*Primary Examiner*—Mark Paschall
(74) *Attorney, Agent, or Firm*—H. Neil Houser; George L. Rideout, Jr.

(57) ABSTRACT

A control system for a glass touch cooktop includes a control panel including a plurality of touch control areas with touch toggle controls that correspond to a plurality of surface heater elements, and a toggle lock control that disables the touch controls areas when activated. The toggle lock control is separated from the touch control, identified with a conspicuous icon, and includes an integral indicator to readily alert a user that the system is locked. Graphical icons and integral indicators are incorporated into touch controls for user-friendly operation of the heating elements.

20 Claims, 3 Drawing Sheets

GLASS TOUCH COOKTOP DUAL ELEMENT AND BRIDGE BURNER CONTROL

BACKGROUND OF THE INVENTION

This invention relates generally to controls for cooking appliances and, more particularly, to a touch control for electric range surface heating elements.

Electric ranges typically include a plurality of surface heating elements. Typically, a user controls the operation of these surface heating elements by mechanically selecting power settings for the surface heating elements via dials or knobs located on a panel near the surface heating elements. The dials or knobs are connected to mechanical switches that control the individual heating elements.

Glass touch control systems typically include a plurality of touch toggle control areas responsive to a touch by a user. Each touch control area electronically controls a corresponding surface heating element. Some touch control systems are confusing to new users, such as systems that incorporate a lock feature that disables the touch controls for safety. Often, it is neither apparent to the uninitiated whether the controls are locked nor evident how to unlock them to operate the range.

Moreover, user-friendly touch controls for combination heating elements, such as dual element burners and bridge heating elements, are needed.

Accordingly, it would be desirable to provide a touch control system that designates the status of the system as locked or unlocked, attracts attention to the lock control, and facilitates the control of dual element burners and bridge elements.

BRIEF SUMMARY OF THE INVENTION

In an exemplary embodiment of the invention, a control system for a glass touch cooktop includes a control panel including a plurality of touch control areas with touch toggle controls that correspond to a plurality of surface heater elements, and a toggle lock control that disables the touch control areas when activated. The toggle lock control is separated from the touch control and is identified with a conspicuous icon for unlocking the touch controls. The toggle lock control further includes an integral indicator to readily alert a user that the system is locked.

Each control area includes on/off touch controls, up and down power controls, and power level displays for intuitive operation by a user. Further, touch controls with graphical icons and integral indicators are incorporated for user-friendly operation of a dual element burner and a bridge element. The indicators are lit in response to the energization of the elements so that a user may see at a glance the status of the elements.

DETAILED DESCRIPTION OF THE INVENTION

Figure 1:
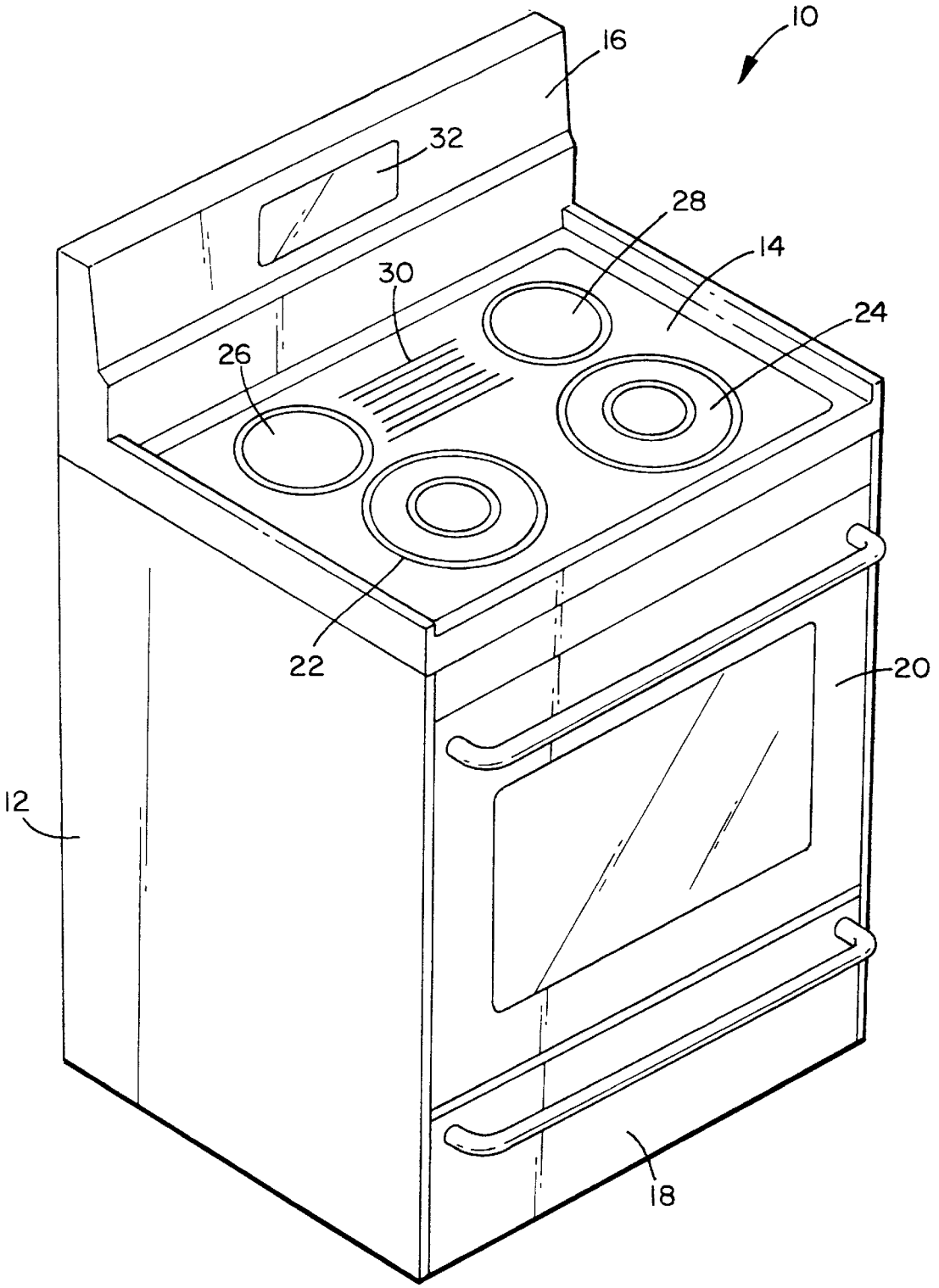
FIG. 1 is a perspective view of a range.

FIG. 1 is a perspective view of a range 10 including a base 12, a range surface 14, and a control riser 16. Base 12 includes a storage drawer 18 for the storage of pots, pans, broilers, etc, and an oven door 20 allowing access to an oven chamber (not shown). The oven chamber is positioned within base 12 and above storage drawer 18.

Range surface 14 includes a left front burner 22, a right front burner 24, a left rear burner 26, a right rear burner 28, and center rear heating element 30 between left rear burner 26 and right rear burner 28. Right front burner 24 is a dual element heater capable of heating in a 6 inch mode or 9 inch mode. Left rear burner 26 is a warming element. The remaining heating elements 22, 28, 30 are single element heaters. A bridge element (not shown) allows the combined operation of left 26, center 30, and right rear 28 burners. Of course, the number of heating elements, the type of heating elements (i.e., single or double element) and the arrangement of the elements may be varied on range surface 14.

Control riser 16 extends upwardly from the rear end of range surface 14 and includes a surface heating element control panel 32. Control riser 16 further includes oven controls (not shown) and other accessories such as clocks or timers (not shown). In an alternative embodiment, control panel 32 is located in front of and below range surface 14. In a further alternative embodiment, control panel 32 is remotely located from range surface 14 as part of a cabinet structure or counter top.

Figure 2:
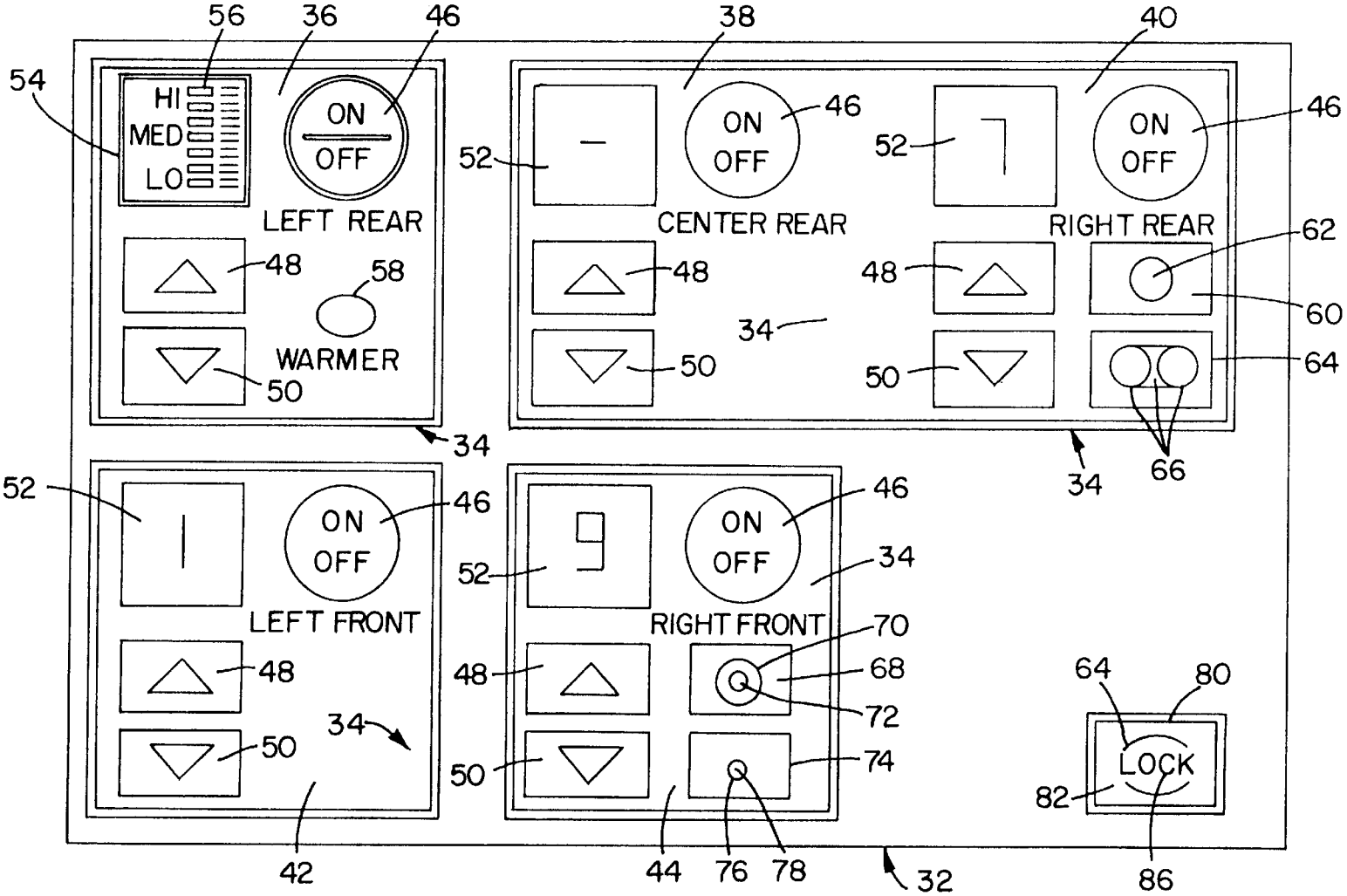
FIG. 2 is a top plan view of a control panel.

FIG. 2 is a top plan view of control panel 32 including a plurality of touch control areas 34 that correspond to one of heating elements 22, 24, 26, 28 and 30 of FIG. 1. More specifically, control panel 32 includes a left rear element control area 36 corresponding to left rear burner 26, a center rear element control area 38 corresponding to center rear burner 30, a right rear element control area 40 corresponding to right rear burner 28, a left front element control area 42 corresponding to left front burner 22, and a right front element control area 44 corresponding to right front burner 24. Each control area 34 includes on/off touch control pads 46, power level up pads 48, and power level down pads 50.

Left front control area 42, right front control area 44, right rear control area 40, and center rear control area 38 include alphanumeric power level displays 52 that indicate power levels according to one of eleven settings from lowest power to highest power: L, 1, 2, 3, 4, 5, 6, 7, 8, 9 and H. Left rear control area 36 includes a bar graph power display 54 including nine horizontal bars 56 vertically stacked to indicate one of nine power levels, with the lowest bar indicating the lowest power setting and the highest bar indicating the highest power setting. Left rear element control area 36 further includes a "warmer" graphical icon 58 to indicate left rear burner 26 (shown in FIG. 1) as a warmer element with a reduced power range.

Right rear control area 40 has a single element control pad 60 with a graphical icon and an integral indicator 62 that is lit when the right rear burner is energized. Right rear control area 40 also includes a second combined bridge element control pad 64 with a graphical icon and multiple integral indicators 66 that are lit when left rear 26 burner (FIG. 1), center rear burner 30 (FIG. 1) and right rear burner 28 (FIG. 1) are operated in combination.

Right front control area 44 includes a 9 inch burner touch control pad 68 with a graphical icon 70 and an integral indicator 72 that is lit when right front dual element burner 24 is operated in 9 inch mode. Right front control area 44 further includes a 6 inch burner touch control pad 74 with a graphical icon 76 and an integral indicator 78 that is lit when right front dual element burner 24 (FIG. 1) is operated in 6 inch mode.

A lock touch control area 80 is separated from touch control areas 36, 38, 40, 42, and 44 and includes a lock pad 82 with a graphical lock icon 84 and an integral indicator 86 that is lit when a lock feature is activated, as explained below.

Figure 3:
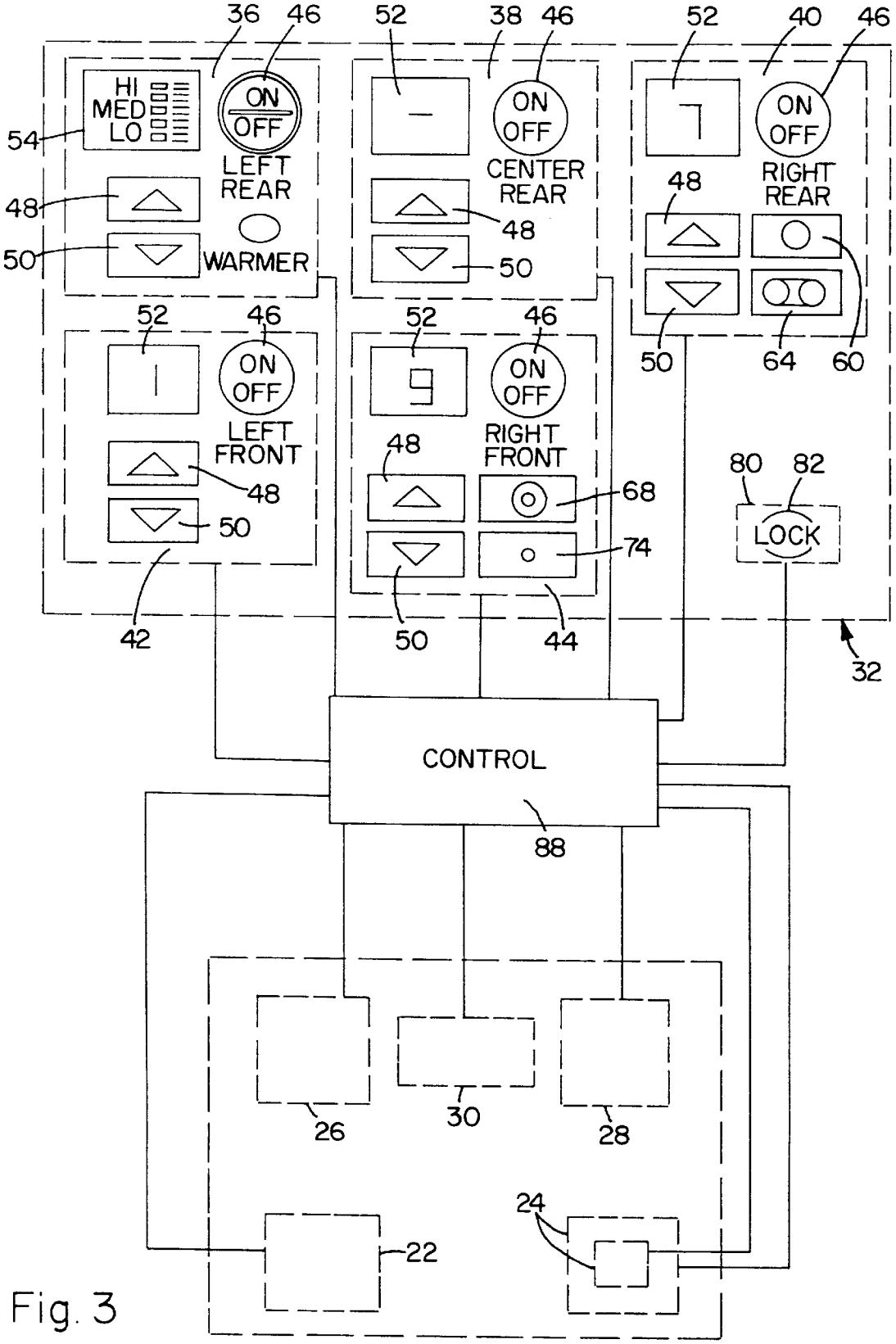
FIG. 3 is a schematic diagram of a control system for the control panel shown in FIG. 2.

FIG. 3 is a schematic diagram of control panel 32 in operational connection with heating elements 22, 24, 26, 28, 30. Each touch control pad of each touch control area 36, 38, 40, 42, and 44 is connected to a control 88. Control 88 includes a microprocessor (not shown) or other electronic elements for executing the functions described below.

Each indicator of each control area 36, 38, 40, 42, and 44 is connected to control 88 and is responsive thereto. Heating elements 22, 24, 26, 28 and 30 are connected to control 88 and are operationally responsive through control 88 to inputs from a user via manipulation of control panel 32. Operation of heating elements 22, 24, 26, 28 and 30 in response to manipulation of control areas 36, 38, 40, 42, and 44 is subject to the following control scheme.

Power Up/Initialization

When power is first applied, or restored after a power outage, control panel 32 flashes "8" in all alphanumeric power level displays 52 for 4 seconds at a frequency of 1 Hz with a 50% duty cycle. Warming bar graph display 54 will also flash at the same frequency and duty cycle. Upon completion of the flashing sequence, control 88 will begin normal power operation as described below. If an on/off control pad 46 is touched during the power up sequence, the power up sequence will be terminated and touch control pads will be processed as set forth below.

Idle Mode

When control 88 is powered up and not in the locked mode, and no heating elements are being energized, the system is in the "idle mode." In the idle mode, only the on/off control pads 46 for each control area 36, 38, 40, 42, and 44 and lock control area 80 are operable. All other touch control pads are unresponsive in the idle mode.

Lock Operation

To activate the lock feature, lock control pad 82 is touched and held for 2 seconds. After a 2 second touch, control 88 will beep once and illuminate LED 86 (shown in FIG. 2) behind lock pad icon 84. LED 86 indicates that control panel 32 is in the locked mode. When control panel 32 is locked, all pads with the exception of lock pad 82 are unresponsive. If any heating elements are active when control panel 32 is locked, the elements are turned off as part of the locking process, and power will not be restored to any element as long as control panel 32 is locked.

Control panel 32 is unlocked by pressing and holding lock pad 82 for 2 seconds. Control 88 will beep twice, turn off LED 86 behind lock pad 82 and return to idle mode.

Power Control Operation

When a control area on/off touch pad 46 is touched and the corresponding heating element is not energized, control 88 will beep and flash "0" in the corresponding alphanumeric power display 52 and the corresponding power level up pad 48 and power level down pad 50 are activated. Heating mode is entered when a corresponding power up pad 48 or power down pad 50 is depressed. If power level up pad 48 is pressed within seven seconds of the on/off control pad 46, control 88 will beep, energize the corresponding heating element at full power, and display an "H" in corresponding power level display 52. If power level down control pad 50 is pressed within seven seconds of on/off touch control pad 46, control 88 will beep, energize the corresponding heater at the lowest power setting, and display an "L" in corresponding power level display 52. If neither power level up pad 48 or power level down pad 50 is pressed within seven seconds of control area on/off control pad 46, corresponding power level display 52 is turned off and control 88 returns to the idle mode.

Once a control area 34 enters the heating mode, on/off control pad 46, and power level up and down control pads 48, 50 are active. If on/off pad 46 is touched, control 88 will beep, turn the corresponding heater element off, and turn power level display 52 off. Touch control area 34 will then return to the idle mode.

Eleven power settings (L, 1, 2, 3, 4, 5, 6, 7, 8, 9, and H) are available for each heating element 22, 24, 26, 28 and 30. If power level up control pad 48 is touched while corresponding control area 34 is in the active heating mode, control 88 will beep and, if the power level is below the highest power setting "H," the power level will be increased one power level. If a power up pad 48 is touched and held for one second or longer while a control area 34 is in heating mode, the power to the corresponding heating element will be increased at a rate of three power levels per second.

If a down control pad 50 is touched while a control area 34 is in the active heating mode, control 88 will beep and, if the power level is not already at the lowest power setting "L," the power level will be decreased by one power setting. If a power level down control pad 50 is touched and held for one second or longer, the power will be decreased at a rate of three power levels per second.

Dual Ring Element Operation

Right front burner dual heating element 24 is operable in 6 inch mode or 9 inch mode using the 6 inch touch control pad 74 or 9 inch touch control pad 68. The 6 inch and 9 inch control pads 74, 68 are inactive until dual element on/off control 46 is touched. Once dual element on/off control 46 is touched, the system defaults to 9 inch mode, and LED 72 (shown in FIG. 2) behind 9 inch icon 70 (shown in FIG. 2) is illuminated. The 6 inch mode may be selected by pressing 6 inch touch control pad 74. Dual heating element 24 will not be energized, however, unless either right front power up pad 48 or power down pad 50 is depressed. Once dual heating element 24 is energized, the 6 or 9 inch mode may be changed by pressing the appropriate touch control pad 74, 68, and the power level in the new mode will remain at the same level before the heating mode was changed.

Bridge Element Operation

Right rear control area 40 has two additional controls for selecting either the right rear burner 28, or the combination of the right rear burner 28, left rear burner 26, and center rear burner 30 via the bridge element. Right rear element icon 60 has an icon with LED 62 (shown in FIG. 2) to indicate that only right rear burner 28 is energized. Combined control pad 64 has an icon and three LEDs 66 (shown in FIG. 2) to indicate the operation of rear burners 26, 28, 30 in combination.

When right rear on/off control pad 46 is turned on, control defaults to right rear element 28 only and right rear control area 40 functions as any other control area.

If combined bridge element control pad 64 is touched, right rear LED 62 is turned off and combined LEDs 66 are turned on. Center rear control area 38 is disabled. Center segment of alphanumeric power display 52, i.e., a dash, is displayed in center rear power display (as illustrated in FIG. 2) and power level up and down control pads 48, 50 of center rear control area 38 are disabled. Center rear on/off control pad 46 turns combined elements 26, 28, 30 off if touched. Once combined element mode is selected, right rear control 40 functions as a normal element control for combined elements 26, 28, 30. Right rear on/off pad 46 is utilized to turn elements 26, 28, 30 off when elements 26, 28, 30 are in the combined element mode.

If right rear touch control pad 60 is depressed during the combined element mode, left rear element 26 and center rear element 30 will be turned off, and right rear element 28 continues to be energized at the same power level that element 26, 28, 30 were energized prior to right rear control pad 60 being touched. If combined bridge element control pad 64 is touched again, all three elements 26, 28, 30 are turned on at the selected power level. If center rear element 30 is operating when combined element control pad 64 is depressed, center rear element 30 will not be returned to its prior operating state when combined element mode is terminated. Rather, center rear heating element 30 will be turned off when combined element mode is turned off.

Warming Element Operation

Left rear warming element control area 36 operation is similar to the power operation described above with the following notable differences. Nine power levels are available for the warming element rather than the 11 power levels for the other burners. The warming element power display 54 is a nine level bar graph rather than an alphanumeric display 52, and all nine segments of the bar graph display will flash after the on/off control 46 is depressed until either control up control 48 or down control 50 is depressed.

Thus, a user friendly touch control system is provided that allows a user to see the status of all heating elements at a glance. Integral indicators and graphical icons clearly indicate the locked/unlocked status of the controls, and facilitate operation of dual burner elements and bridge burners.

While the invention has been described in terms of various specific embodiments, those skilled in the art will appreciate that the invention can be practiced with modification within the spirit and scope of the claims.

What is claimed is:

1. A control system for a glass touch cooktop, the cooktop including at least one heating element, said control system comprising:

a control panel comprising at least one touch control area corresponding to the at least one heating element, the heating element operatively responsive to an input from said touch control area; and a touch toggle lock control operatively connected to the at least one operant touch control area, said lock control disabling operation of said control areas when activated, said lock control having an integral indicator to indicate activation of said lock control.

2. A control system in accordance with claim 1 wherein said at least one control area comprises:

a touch toggle power switch operatively connected to said heating element for activation thereof; and at least one power level touch toggle switch operatively connected to said heating element for adjusting the energization of said heating element.

3. A control system in accordance with claim 2 wherein said at least one touch control area further comprises a power level display.

4. A control system in accordance with claim 3 wherein said power level display comprises a numerical display.

5. A control system in accordance with claim 3 wherein said power level display comprises a bar graph.

6. A control system in accordance with claim 3 wherein said at least one touch control area operatively connects a plurality of heating elements, said touch control area further comprising at least one graphical icon, said icon including an indicator to indicate the energization of at least one of said heating elements.

7. A control system in accordance with claim 6 wherein said touch control area is connected to a dual ring burner.

8. A control system in accordance with claim 6 wherein said plurality of heating elements includes a bridge element.

9. A control system for a glass touch cooktop, the cooktop including at least a first heating element, a second heating element, and a bridge heating element, the bridge heating element positioned between the first and second heating elements and operatively connected thereto, said control system comprising:

a control pad comprising a plurality of touch control areas corresponding to the first, second and bridge heating elements, one of said touch control areas comprising a graphical icon and a plurality of indicators to indicate the energization of the first, second and bridge heating elements.

10. A control system in accordance with claim 9 wherein one of said touch control areas comprises a bar graph display.

11. A control system in accordance with claim 10 wherein each of the touch control areas comprise:

a touch toggle power switch operatively connected to said heating element for activation thereof; and at least one power level touch toggle switch operatively connected to said heating element for adjusting the energizing of said heating element.

12. A control system in accordance with claim 11 wherein one of said touch control areas comprises a numerical power level display.

13. A control system in accordance with claim 12 wherein the control panel further comprises a touch toggle lock control operatively connected to said touch control areas, said lock control disabling operation of said control areas when activated, said lock control including an integral indicator to indicate activation of said lock control.

14. A control system in accordance with claim 9 wherein the cooktop further includes a dual ring heating element control area, said dual ring heating element control area comprising at least one graphical icon, said icon including an indicator to indicate energization of the first heating element and the second heating element.

15. A method for controlling a glass touch cooktop, the cooktop including a controller, a control panel, and a plurality of heating elements operatively connected thereto, the control panel including a plurality of control areas operatively connected to a corresponding heating element, each of the control areas including a touch toggle power switch, up and down power level switches and a power level display, said method comprising the steps of:

prompting a power level setting upon activation of the power toggle switch by displaying a flashing zero in the power level display;

enabling the power level switches for a preset period of time;

energizing the corresponding heating element at full power and indicating the full power energization of the heating element in the power level display in response to activation of the up switch; and energizing the heating element at low power and displaying the low power energization of the heating element in the power level display in response to activation of the down switch.

16. A method in accordance with claim 15 further comprising the step of disabling the power level switches and turning off the power level display if neither power level switch is activated within a preset time from activation of the power switch.

17. A method in accordance with claim 15 wherein said heater has a high power level, a low power level and nine power levels therebetween, said method comprising the step of changing the power level by one level increments in response to touch activation of the power level switches.

18. A method in accordance with claim 17 further comprising the step of changing the power level by three level increments upon continuous touch activation of power level switches for a predetermined time.

19. A method in accordance with claim 18 wherein the control panel further includes a lock control touch toggle area including an integral indicator, said method further comprising the steps of:

disabling the control areas of the control panel upon continuous activation of the lock switch for a predetermined period of time; and energizing the indicator.

20. A method in accordance with claim 19 further comprising the step of enabling the control areas upon continuous activation of the lock switch for a predetermined period of time.

* * * * *